US005836183A

United States Patent [19]

Derman

[11] Patent Number: 5,836,183

[45] Date of Patent: Nov. 17, 1998

[54] SECURITY DEVICE FOR LAPTOP COMPUTERS

[75] Inventor: Jay S. Derman, Redondo Beach, Calif.

[73] Assignee: ACCO Brands, Inc., Lincolnshire, Ill.

[21] Appl. No.: 842,475

[22] Filed: Apr. 23, 1997

[51] Int. Cl.[6] ..... E05B 69/00

[52] U.S. Cl. ..... 70/58; 70/164; 248/553

[58] Field of Search ..... 70/14, 18, 19, 70/57, 58, 163, 164, 158; 248/551–553

[56] References Cited

U.S. PATENT DOCUMENTS

| | | | |
|---|---|---|---|
| 3,895,768 | 7/1975 | Scheck | 248/553 |
| 4,028,913 | 6/1977 | Falk | 248/553 X |
| 4,081,978 | 4/1978 | Ivey | 248/553 X |
| 4,453,692 | 6/1984 | LeDoux et al. | 70/58 |
| 4,535,863 | 8/1985 | Becker | 248/551 X |
| 4,564,167 | 1/1986 | Smith | 248/552 |
| 4,696,449 | 9/1987 | Woo et al. | 248/553 |
| 5,052,651 | 10/1991 | Guddee | 248/552 |
| 5,085,395 | 2/1992 | Frater et al. | 248/552 |
| 5,135,197 | 8/1992 | Kelley et al. | 248/551 |
| 5,595,074 | 1/1997 | Munro | 248/553 X |
| 5,642,634 | 7/1997 | Perry | 70/164 X |
| 5,645,261 | 7/1997 | Glynn | 248/551 |

*Primary Examiner*—Suzanne Dino
*Attorney, Agent, or Firm*—Townsend and Townsend and Crew LLP

[57] ABSTRACT

A portable device for securing a laptop computer from theft. Provision is made for locking the device to an immovable object by cable or by padlock. The device comprises a base, a retaining rod fastened across the width of the base and a locking post. A laptop computer would be placed with its keyboard between the base and retaining rod, and a locking post is inserted vertically in the rear of the base, protruding upwards behind the opened laptop. This prevents the laptop from from being pulled rearward out from under the retaining rod and removed from the device. When not in use, the device retaining rod may be rotated downwards so that the device becomes flat and is readily stored or carried. The device is light in weight and low in cost.

8 Claims, 2 Drawing Sheets

SECURITY DEVICE FOR LAPTOP COMPUTERS

BACKGROUND OF THE INVENTION

1. Field of the Invention

The invention relates to devices for preventing the theft of small, expensive electronic equipment and particularly to securing laptop computers from theft.

2. Background

The class of personal computers known as laptop computers or notebook computers, describes a computer which is small in to size, rectangular in shape and designed to open and close like a book. It comprises a flat screen monitor display and a keyboard which also contains the computer electronic circuitry. The monitor is attached by a hinge to the keyboard and also acts as a cover for the device when rotated over the keyboard. This feature makes the device convenient for storage or carrying. However, it also makes it easier to steal.

Laptop computers are expensive, typically selling in the range of $2,000 to $3,000. Since they are also small in size, they are an attractive target for thieves.

At present, computer equipment stores use elaborate arrays of locked bars to secure displayed laptop computers. These locking arrays are expensive and not portable. However, an individual PC owner has no such securing device available. There is therefore a need for a portable securing device for laptop computers that can be used by individual PC owners or by a store for sales display purposes.

SUMMARY OF THE INVENTION

The present invention is a portable device on which a laptop computer may be placed, retained, locked in place and be operated. Provision is made for securing the device to an immovable post either by cable or by padlock. The device comprises a base, a retaining rod fastened across the width of the base and a locking post. After a laptop Computer is placed with its keyboard between the base and the retaining rod, the locking post is inserted vertically through one of three holes in the base, located behind the opened laptop. A securing cable may then be inserted through a hole in the locking post or a chain and padlock may be used instead. While in place, the locking post prevents rearward removal of the laptop computer from the device, while permitting normal operation of the computer. When not in use, the device retaining rod is rotated downwards so that the device becomes flat and readily stored or carried.

Accordingly, it is an object of the present invention to provide a securing device for an individual laptop computer that is simple and portable.

Another object is to provide a securing device that could be used for sales displays or for an individual user.

Yet another object is to provide a securing device for laptop computers that is inexpensive.

Further objects and advantages of the present invention will be apparent from study of the specification description, the claims and the attached drawings.

DESCRIPTION OF THE PREFERRED EMBODIMENT

Figure 1:
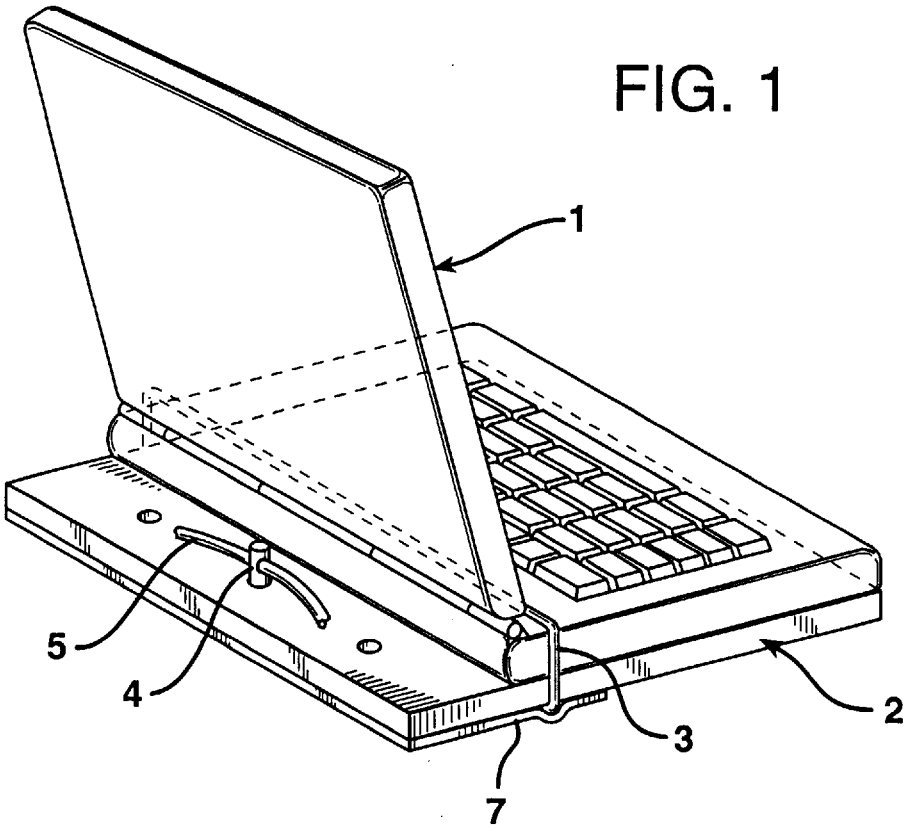
FIG. 1 is a perspective view of a laptop computer locked in place on the security device according to the present invention.
Figure 2:
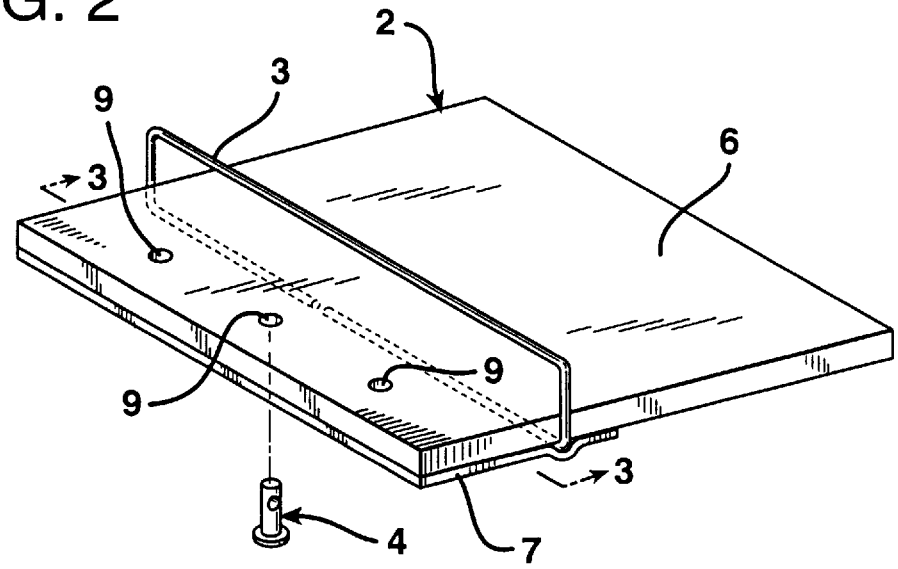
FIG. 2 is perspective view of the security device according to the present invention.

Referring particularly to the drawings, there is shown respectively in FIGS. 1 and 2, a perspective view of a laptop computer 1 placed in a security device 2 and a perspective view of a security device 2 in accordance with the present invention.

The laptop computer 1 is shown with its keyboard inserted under a rotatable retaining rod 3 and pushed forward on the flat surface of the device base 6 until the retaining rod 3 is close to the bottom of the laptop hinged monitor. A post member 4 is inserted through one of three holes 9 in the device base 6 which are located behind the laptop, and the post member 4 projects upwards, preventing rearward removal of the laptop computer 1 from the device 2. A cable 5 or a padlock or other locking means may then be attached to the security device 2 through a hole in the post member 4, and thence to an immovable object. Thus securing the device and the laptop computer from thieves while permitting operation of the laptop computer 1 if so desired.

Three post holes 9 in the base 6 are provided, spaced apart in a row and located behind the retaining rod 3 for use by the post member 4. These three holes are provided to allow an inserted post member 4 to avoid obstructing any connector and wires that may be attached to the rear of a laptop computer.

As depicted in FIG. 2, the retaining rod 3 is a rectangular shaped, rigid metal rod. It could also be made of thin, rigid tubing. The rod height is selected to provide clearance between the rod 3 and the top of a keyboard when a laptop computer is inserted in the device. A grooved plate member 7 is fastened to the bottom surface of the base 6 and serves as a means for securing the rectangular shaped, retaining rod 3 to the base 6, allowing the rod 3 to be rotated above the base so that it can be stowed flat.

Figure 3:
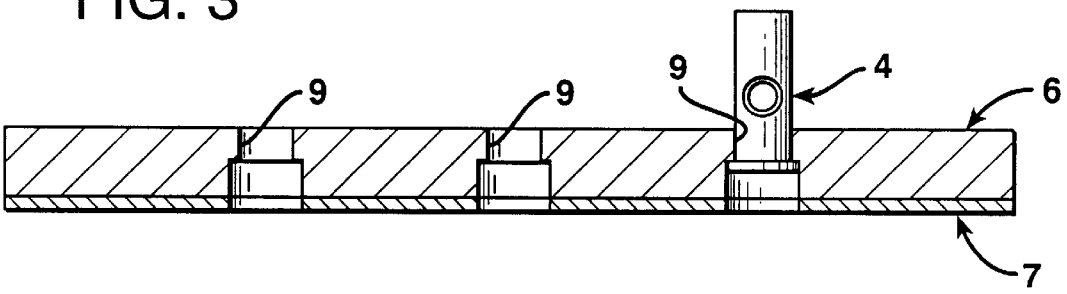
FIG. 3 is a cross-section elevation view of the invention base taken along line 3—3 of FIG. 2, particularly showing three counter-sunk holes and a post member inserted in one of the holes.

Refer now to FIG. 3 which is a cross-section view of the invention taken along line 3—3 of FIG. 2. Each of the three post holes 9 in the base 6 are seen to be counter-sunk from the bottom. This is done to provide a ledge for stopping and seating the post member 4, which is shown in one of the post holes 9.

Figure 4:
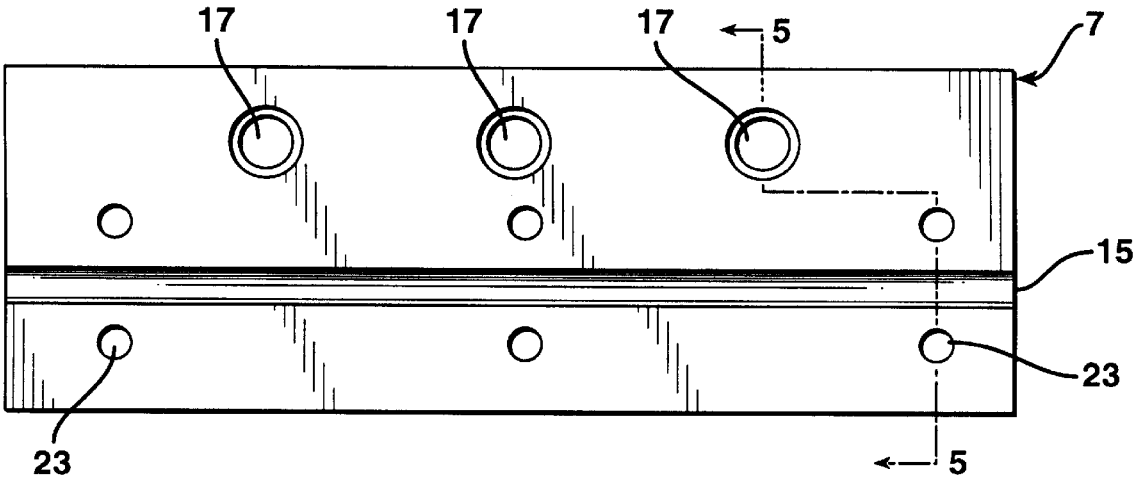
FIG. 4 is a plan view of a grooved bottom plate that is used for holding a rotatable retaining rod to the base.
Figure 5:
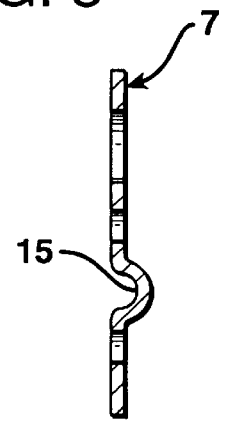
FIG. 5 is an end elevation view of the bottom plate, taken along line 5—5 of FIG. 4, particularly showing a groove formed for seating and retaining the rod.

Refer to FIG. 4 which is a plan view of a plate member 7. FIG.5 is a cross-section view of the plate member taken along line 5—5 of FIG. 4 showing a groove 15 across the width of the plate member 7. The groove 15 is made deep enough to accommodate the diameter of the retaining rod 3 wire or tubing, with clearance allowing the rod to be rotated. Three large holes 17 are cut in the plate member 7 and located to match the location of the post holes 9 in the base 6 when the plate member 7 is placed under the base 6 at its back end. Also shown are a multiple number of smaller holes 23 cut through the plate member 7. These smaller holes 23 are for the purpose of fastening the plate member 7 to the underside of the base 6 using screw fasteners. However, the plate member 7 may be bonded to the base 6 by other means, including for example an adhesive or a weld.

Figure 6:
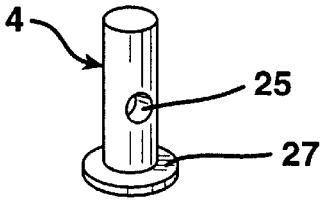
FIG. 6 is an elevation view of the post member.

FIG. 6 illustrates a post member 4 which is a simple, cylindrical metal bolt having a flat capped head 27, and a cable hole 26 bored through it at 90 degrees to its cylinder longitudinal axis. The post member diameter is sized to fit with clearance in any post hole 9 and its head 27 is sized to fit closely into the counter-sunk portion of a post hole 9.

Regarding the overall weight of the device, the base 6 and plate member 7 may be constructed of any suitable, rigid, strong material that is light in weight. The retaining rod 3 and the post member 4 should be metal since they are the prime retainers for any laptop computer placed on the device.

The resulting device weight is then a little more than one pound, which is a convenient light weight for use by an individual or for carrying.

The device is simple in construction and economic to manufacture. It should therefore be relatively low in cost for an individual user.

The device retaining rod secures a computer without covering a large part of a laptop computer keyboard as is usually the case when bars are used in a store display. Use of the invention security device can thus enhance store displays of laptop computers as well as being economical.

From the foregoing description, it is clear that the objects of the present invention have been met.

Alternative embodiments and modifications may be apparent to those skilled in the art. These alternatives and modifications are considered to be within the spirit and scope of the present invention.

Having described the invention, what is claimed is:

1. A device for securing a laptop computer from theft, the laptop computer having a keyboard portion with a monitor portion hinged at an angle thereto when said laptop computer is in operation, comprising:

a base member, having a generally planar top surface and dimensioned to support the keyboard portion of the laptop computer on said top surface, said base member being made of a rigid material;

means for retaining the laptop computer to the top surface of said base member when said laptop computer is opened for operation; and means for preventing removal of the laptop computer from said base member when retained, and securing said laptop computer from theft.

2. The device as defined in claim 1, wherein said means for retaining the laptop computer to the top surface of said base member includes a metal rod member bent in an elongated rectangular shape, and second means for rotatably retaining said rod member to said base member, said rectangular shape of said rod member being dimensioned to fit under and over a width of said base member with clearance, and over the keyboard portion of the laptop computer when retained to said base member with clearance, said rod member being rotatably secured by said second means, permitting said rod member to be rotated until a top portion of the rod member lies flat against the top surface of said base member.

3. The device as defined in claim 1, wherein said means for preventing the removal of a laptop computer from said base member includes a multiplicity of first holes in said base member, and a metal post member; said first holes being separated a distance apart from each other and located in a row across a rear edge of said base member and behind the position to be occupied by a laptop computer when retained on said base member; said post member having a cylindrical body with a flat, radially projecting cap at a bottom end, said cylindrical body being dimensioned to fit inside a first hole in said base member and protrude upwards an amount above the top surface of said base member, thereby preventing a retained laptop computer from being withdrawn rearward from said device, said cylindrical body including a second hole bored therethrough at 90 degrees to a longitudinal axis thereof for the purpose of accommodating a securing cable, chain or padlock.

4. The device as recited in claim 2, wherein said second means for rotatably retaining said rod member to said base member includes a plate member and means for fastening said plate member to the underside of said base member, said plate member having a width approximately equal to the width of said base member and having a deep groove formed therein, said groove being dimensioned to hold the lower portion of said rod member against the bottom face of said base member, permitting said rod member to be rotated.

5. A computer locking system, comprising:

a laptop computer having a keyboard portion and a hingedly connected monitor portion; and a device for securing the laptop computer from theft, further comprising:

a base member of generally flat rectangular proportions, the base having a top surface, a bottom surface, and a rear edge, said rear edge having at least one hole;

a retaining rod having an elongated rectangular shape and being comprised of a narrow, rigid material, the retaining rod fitting around a width of the base with clearance above the top surface;

a plate member coupled to said base bottom surface, the plate member having a width complementary to the width of the base and having a groove along said plate member width adapted to conform around said retaining rod to secure the retaining rod to the base; and a post member extending upwards through said base member hole preventing rearward removal of the laptop computer from the base.

6. A method of securing a laptop computer from theft, the laptop computer having a keyboard portion and a monitor portion hingedly connected thereto, wherein the monitor portion is positioned at an angle to the keyboard portion, the method comprising:

providing a base of generally flat proportions, the base having a top surface, a bottom surface, and a rear edge, said rear edge having a plurality of holes;

placing a retaining rod around the base, the retaining rod having an elongated rectangular shape and being comprised of a narrow, rigid material, the retaining rod fitting around a width of the base with clearance above the top surface;

fastening a plate member to the base bottom surface, the plate member having a width complementary to the base and further comprising a groove for securing the retaining rod to the base;

placing the keyboard portion of the laptop computer onto the base and under the retaining rod, the monitor portion preventing forward removal of the laptop computer;

inserting, through one of the plurality of large holes in the base, a post member, the post member having a flat capped shaped first end and an apertured second end, wherein the second end extends upwardly beyond the said large hole thereby preventing rearward removal of the laptop computer from the base; and fixing the post member in place by inserting a cable or padlock through the apertured second end.

7. The method of claim 6 wherein the base is rectangular in shape.

8. The method of claim 6 wherein each of said plurality of large holes further comprise a ledge and narrowed hole, and wherein said post member's flat capped first end abuts said ledge and said post member's apertured second end is complementary to said narrowed hole.

* * * * *